US007543800B2

(12) United States Patent
Grapes et al.

(10) Patent No.: US 7,543,800 B2
(45) Date of Patent: Jun. 9, 2009

(54) SINGLE STACK MANUAL MARINE WINCH

(75) Inventors: David B Grapes, Pittsburgh, PA (US); Russell J Mayhew, Pittsburgh, PA (US); Eric Konvolinka, Pittsburgh, PA (US); Erik R. Arlet, Mount Lebanon, PA (US)

(73) Assignee: W.W. Patterson Company, Pittsburgh, PA (US)

( * ) Notice: Subject to any disclaimer, the term of this patent is extended or adjusted under 35 U.S.C. 154(b) by 0 days.

(21) Appl. No.: 11/832,627

(22) Filed: Aug. 1, 2007

(65) Prior Publication Data

US 2008/0048162 A1 Feb. 28, 2008

Related U.S. Application Data

(60) Provisional application No. 60/821,061, filed on Aug. 1, 2006.

(51) Int. Cl.
*B66D 5/32* (2006.01)

(52) U.S. Cl. ..... 254/376; 254/332; 254/357

(58) Field of Classification Search ..... 254/278, 254/382, 332, 342, 352, 237, 376, 357
See application file for complete search history.

(56) References Cited

U.S. PATENT DOCUMENTS

| | | | | |
|---|---|---|---|---|
| 1,984,604 | A | 12/1934 | Stahl | |
| 2,019,511 | A | 11/1935 | Stahl | |
| 2,549,172 | A | 4/1951 | Cline | |
| 3,353,793 | A | 11/1967 | Nelson | |
| 3,836,123 | A | 9/1974 | Bausenbach | |
| 3,843,094 | A | 10/1974 | Watts | |
| 3,960,340 | A * | 6/1976 | Naas | 242/603 |
| 4,106,754 | A * | 8/1978 | Kucher | 254/352 |
| 4,456,227 | A * | 6/1984 | Notenboom | 254/350 |
| 4,611,688 | A | 9/1986 | Sekhar | |
| 4,721,285 | A | 1/1988 | McMichael | |
| 5,358,190 | A | 10/1994 | Fladung | |
| 5,522,336 | A * | 6/1996 | Fujita | 114/293 |
| 5,669,575 | A | 9/1997 | Byle | |
| 5,779,226 | A * | 7/1998 | Wudtke | 254/278 |
| 5,947,450 | A | 9/1999 | Grapes et al. | |
| 6,116,580 | A * | 9/2000 | Hull | 254/357 |
| 6,247,680 | B1 | 6/2001 | Cohen | |
| 6,386,324 | B1 | 5/2002 | Baranda | |
| 6,394,420 | B2 | 5/2002 | Kiviniitty | |
| 6,431,103 | B1 * | 8/2002 | Meyerdierks | 114/218 |
| 6,431,525 | B1 * | 8/2002 | Roll | 254/357 |
| 6,572,083 | B1 | 6/2003 | Topping et al. | |
| 6,726,182 | B2 | 4/2004 | Topping, Jr. | |
| 6,938,881 | B2 | 9/2005 | Grapes et al. | |
| 7,104,492 | B1 | 9/2006 | Massell et al. | |
| 7,128,307 | B2 | 10/2006 | Dow et al. | |
| 7,159,852 | B2 * | 1/2007 | Dow et al. | 254/342 |
| 2006/0278861 | A1 | 12/2006 | Leslie | |
| 2008/0061277 | A1 * | 3/2008 | Grapes et al. | 254/352 |

* cited by examiner

*Primary Examiner*—Emmanuel M Marcelo
(74) *Attorney, Agent, or Firm*—Blynn L. Shideler; Krisanne Shideler; BLK Law Group

(57) ABSTRACT

A manual marine winch includes a winch line including a wire rope, a pair of spaced side plates, a rotating spool assembly supported between the side plates and including a drum, wherein the drum defines a wire rope stacking space on the drum for storing a single stack of wire rope, and a manually actuated control for spooling and un-spooling the wire rope in the wire rope stacking space on the drum.

20 Claims, 8 Drawing Sheets

SINGLE STACK MANUAL MARINE WINCH

RELATED APPLICATIONS

This application claims the benefit of U.S. Provisional patent application Ser. No. 60/821,061 filed Aug. 1, 2006 entitled "Single Stack Manual Marine Winch."

BACKGROUND OF THE INVENTION

1. Field of the Invention

The present invention relates to winches, more particularly, the present invention relates to manual marine winches designed to minimize binding, simplify unloading and limit the amount of available rope that can be stored on the winch drum.

2. Background Information

Winches have been used in many applications. Manual winches have been widely used in barges, tow boats and the like. Typically a manual winch is attached to a boat deck and spools a towing cable on a rotating drum.

Manual winches remain in common use where a powered winch would be impractical or inefficient. Even in a manual winch the operator, through various mechanical advantages, can generate a very large tension on the cable. Examples of manual winches are described in greater detail in U.S. Pat. No. 5,947,450 which is incorporated herein by reference. Examples of manual winches are sold by W. W. Patterson Company and Nashville Bridge Company.

In a conventional marine winch a wire rope, the winch line, is spooled back and forth around the rotating drum and the winch line is subject to very large loads. The high loading can cause the outer layers of wire rope to become fouled, jammed or begin binding within the spaces between the lower level wire ropes. Further, rapid tension release in existing wire rope winch systems can result in what is known as "bird-nesting" of the spooled wire rope. This can make unwinding the winch very difficult in subsequent operation, and often requires a second deck hand to assist in the unwinding of the wire rope, or even the engine power of the tow boat.

Companies that utilize certain selected lashing arrangements repeatedly will often have a winch wire take up requirement (i.e. total adjustment length of the winch line) that is much less than the wire rope length attached to the winch. Further, controlling the total winch line adjustment in such situations can be used to assure that the deck hands are making the same lashing arrangements in the same proper manner. In other words a winch with a controlled total winch line adjustment or take up can assure the proper lashing configuration or rigging is followed.

It is an object of the present invention to minimize the drawbacks of the existing manual winches and to provide a simple easy loading and unloading marine winch that minimizes fouling, binding, jamming, bird-nesting, and essentially forces that a proper lashing configuration be followed.

SUMMARY OF THE INVENTION

It is noted that, as used in this specification and the appended claims, the singular forms "a," "an," and "the" include plural referents unless expressly and unequivocally limited to one referent. For the purposes of this specification, unless otherwise indicated, all numbers expressing any parameters used in the specification and claims are to be understood as being modified in all instances by the term "about." All numerical ranges herein include all numerical values and ranges of all numerical values within the recited numerical ranges.

The various embodiments and examples of the present invention as presented herein are understood to be illustrative of the present invention and not restrictive thereof and are non-limiting with respect to the scope of the invention.

At least some of the above stated objects are achieved with a manual marine winch that includes a winch line including a wire rope, a pair of spaced side plates, a rotating spool assembly supported between the side plates and including a drum, wherein the drum defines a wire rope stacking space on the drum for storing a single stack of wire rope, and a manually actuated control for spooling and un-spooling the wire rope in the wire rope stacking space on the drum.

The marine winch of the present invention may have the drum including a protecting flange on one side of the drum and a controlling drum gear on the other side of the drum. The marine winch of the invention may further include a stacking flange which is spaced from the drum gear a distance sufficient to receive only a single width of winch line, whereby the drum gear and the stacking flange define the wire rope stacking space. The marine winch of the invention wherein the clearance between the wire rope on the drum centered between the drum gear and the stacking flange is 1-30% of the wire rope diameter on each side of the wire rope.

The marine winch of the present invention may further include a dead wrap area between the stacking flange and the protecting flange. The dead wrap area may be designed to receive a single layer of wire rope with a plurality of wraps such as four wraps. The marine winch of the invention may further including a lead in clamp on the drum to receive the lead in end of the wire rope to begin the dead wraps. The marine winch of the invention may have the stacking flange include a slot that permits the wire rope to pass from the dead wrap area to the stacking area. The marine winch of invention may further include a removable hold down bar secured to the stacking flange extending across the slot which eliminates the possibility of inadvertently unwinding the dead wraps.

These and other advantages of the present invention will be clarified in the brief description of the preferred embodiment taken together with the drawings in which like reference numerals represent like elements throughout.

DESCRIPTION OF THE PREFERRED EMBODIMENTS

Figure 1:
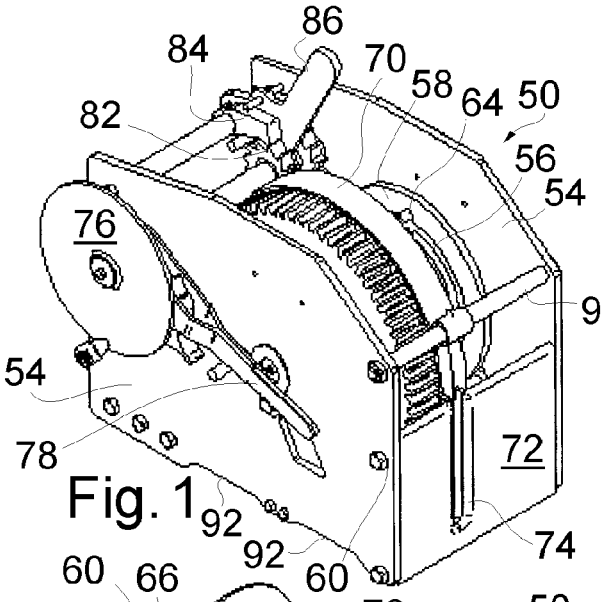
FIG. 1 is a right side perspective view of a single stack manual marine winch according to one aspect of the present invention with the wire rope winch line and winch cover or housing omitted for clarity.
Figure 2:
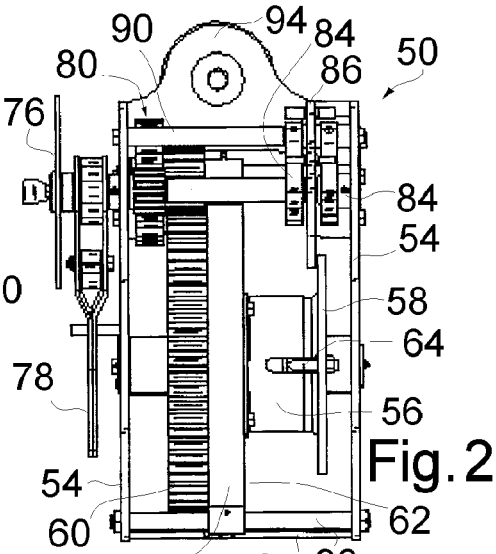
FIG. 2 is top plan view of the marine winch of FIG. 1.
Figure 3:
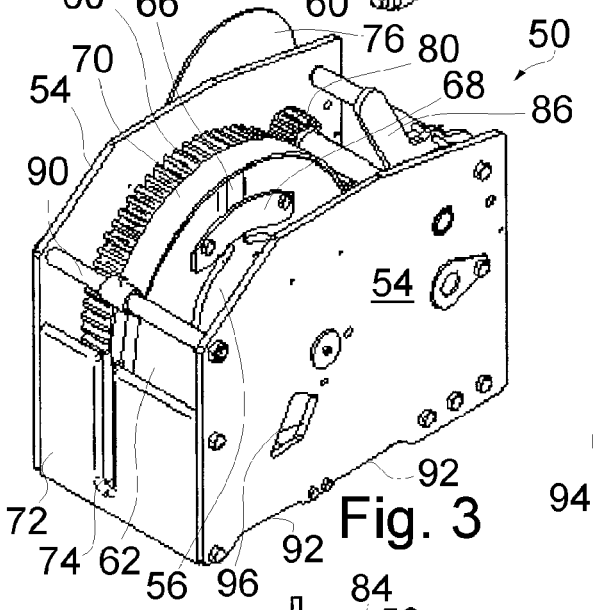
FIG. 3 is a left side perspective view of the marine winch of FIG. 1.
Figure 4:
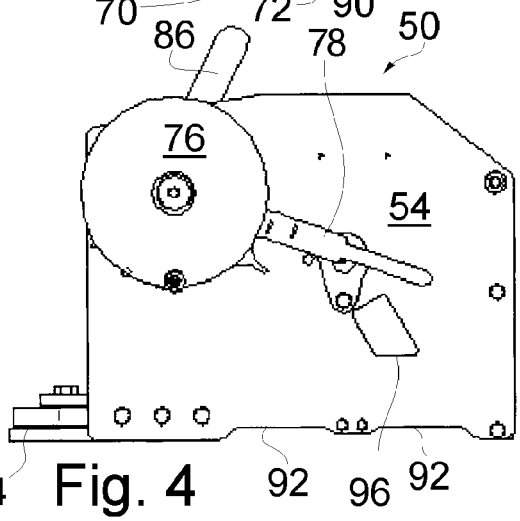
FIG. 4 is a right side elevation view of the marine winch of FIG. 1.
Figure 5:
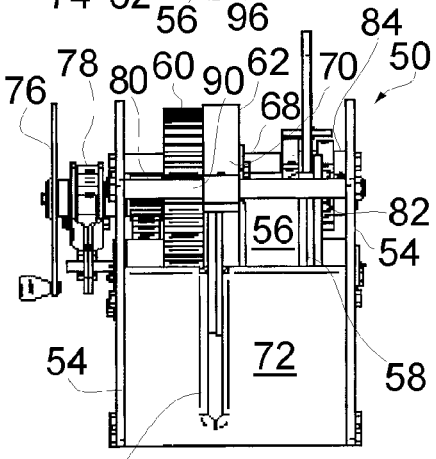
FIG. 5 is front elevation view of the marine winch of FIG. 1.
Figure 6:
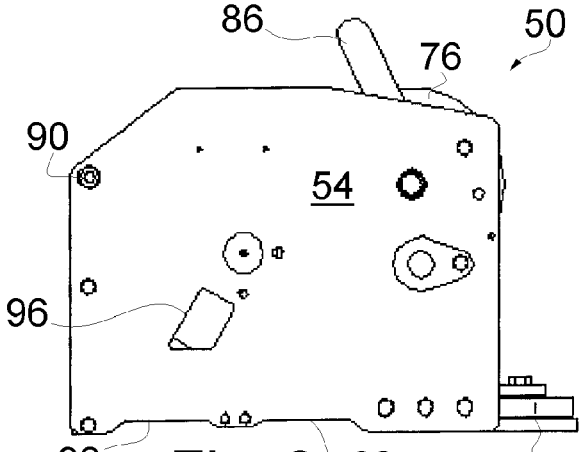
FIG. 6 is a left side elevation view of the marine winch of FIG. 1.
Figure 7:
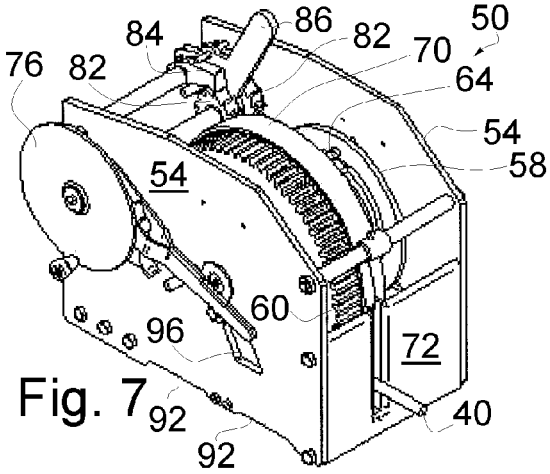
FIG. 7 is a right side perspective view of a single stack manual marine winch according to one aspect of the present invention similar to FIG. 1 with the wire rope winch line included and the winch cover or housing omitted.
Figure 8:
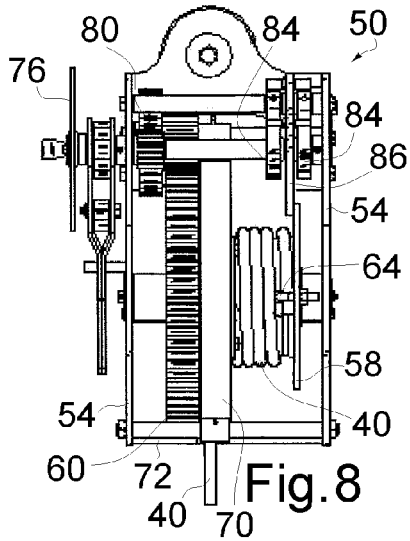
FIG. 8 is top plan view of the marine winch of FIG. 7.
Figure 9:
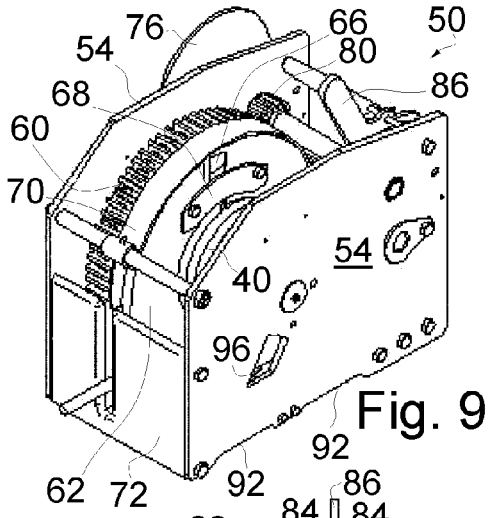
FIG. 9 is a left side perspective view of the marine winch of FIG. 7.
Figure 10:
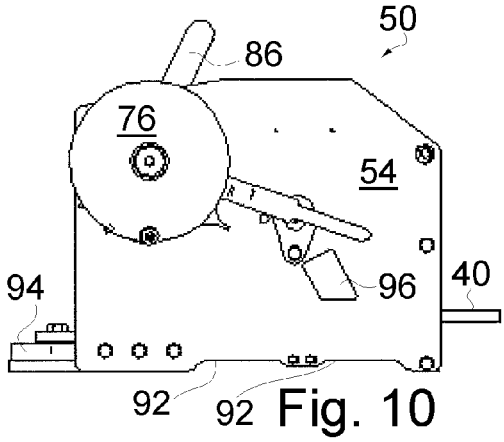
FIG. 10 is a right side elevation view of the marine winch of FIG. 7.
Figure 11:
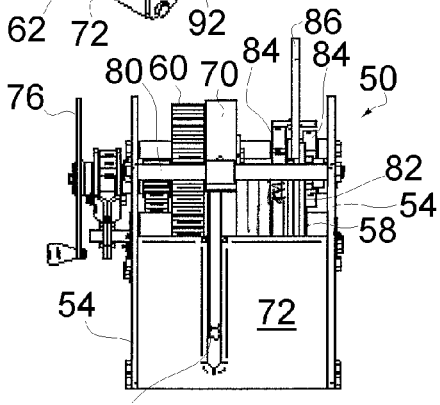
FIG. 11 is front elevation view of the marine winch of FIG. 7.
Figure 12:
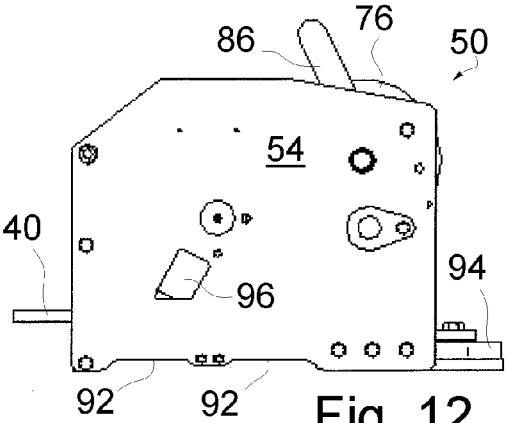
FIG. 12 is a left side elevation view of the marine winch of FIG. 7

FIGS. 1-19 illustrate a single stack manual swivel winch 50 according to the present invention. The winch 50 includes a pair of spaced side plates 54 defining an open bottom. A rotating spool assembly is supported between the side plates 54 and includes drum 56 with a protecting flange 58 on one side of the drum 56 and a controlling drum gear 60 on the other side of the drum 56.

The construction of the spool assembly is the key feature of the present invention. Adjacent the drum gear 60 is a stacking flange 62 which is spaced from the drum gear 60 a distance sufficient to receive only a single width of winch line 40. For example, the clearance between a wire rope 40 on the drum 56 centered between the drum gear 60 and the stacking flange 62 is 1-30%, or possibly 4-10% of the wire rope diameter on each side of the wire rope 40. For example, in a 1" rope a total clearance of about ⅛" (or 1/16" for each side) has been found to form a single stack wire rope stacking space that avoids fouling, binding jamming and the like. The stacking flange 62 and the drum gear 60 form the wire rope stacking space on the drum 56 for storing a single stack of wire rope 40. The "single stack" within this application means that the each layer of wire rope 40 within the stacking space is only a single wire rope 40. Through the formation of a single stack the winch 50 prevents unwanted binding during loading, preventing the jamming during the unwinding. It should be noted that FIGS. 7-19 which illustrate the rope 40 omit the leading portion of the rope 40 that is significantly beyond the winch 50. It is this leading end, of course, of the rope 40 that will be used in the desired lashing arrangements.

The drum 56 includes a "dead wrap" area between the stacking flange 62 and the protecting flange 58. The dead wrap area is designed to receive a single layer of wire rope 40 with sufficient number of wraps to prevent pull out of the wire rope 40 under the desired tension (even with no stacking of the rope 40 in the stacking space). Four wraps of winch line or rope 40 is believed to be a sufficient number of wraps for the dead wrap on the winch 50. For example, four wraps on the drum 56 with a 1" diameter wire rope on a 10" diameter drum 56 has been found to provide full holding capacity for the winch 50, with full holding capacity essentially meaning that the wire rope will break before it is pulled off of the drum 56. A lead in clamp 64 is on the drum to receive the lead in end of the wire rope to begin the dead wraps.

The stacking flange 62 includes a slot 66 that permits the wire rope to pass from the dead wrap area to the stacking area. A removable hold down bar 68 is secured to the stacking flange 62 extending across the slot 66 to ensure that the dead wraps are maintained on the winch at all times (e.g. prevents unwanted removal of the dead wraps). The slot 66 is preferably beveled as shown to allow for easy passage of the wire rope from the dead wrap area to the single stacking area and to prevent cutting or unwanted abrasion of the rope. The lead in clamp 64 is positioned such that the wire rope is aligned with and can easily pass through the slot 66 (with the bar 68 removed) after the desired number of dead wraps. After the wire rope is begun to be spooled within the stacking area (after it passes through the slot 66) the bar 68 can be reattached to the flange 62 as shown.

The winch 50 includes stacking area fender 70 as a protective fender that will help hold the wire rope and to keep in contained. The fender helps form a wrap limiting feature for the winch 50 that prevents over-winding of the winch line. The over-winding prevention mechanisms of the winch 50 serves to control the total winch line adjustment that can be accomplished with the winch 50. This winch line adjustment control will actually force the proper repeated lashing or rigging configuration to be followed. For example, if a significant portion of the desired rigging pattern is omitted then the extra winch line may not be able to be stored on the winch 50 evidencing the undesired rigging arrangement.

Figure 13:
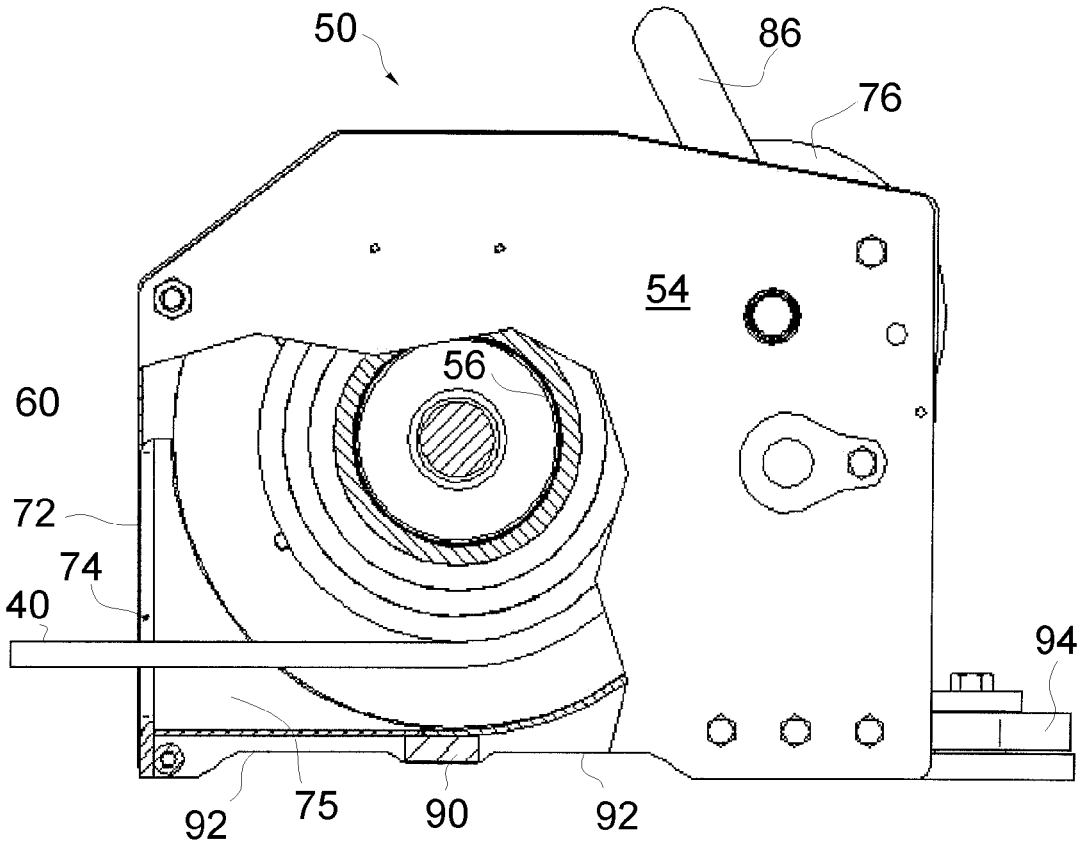
FIG. 13 is a left side elevation view partially in section of the marine winch of FIG. 7.
Figure 17:
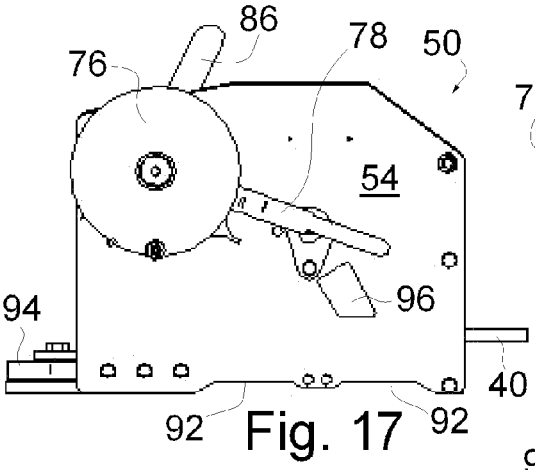
FIG. 17 is a right side elevation view of the marine winch of FIG. 14.
Figure 14:
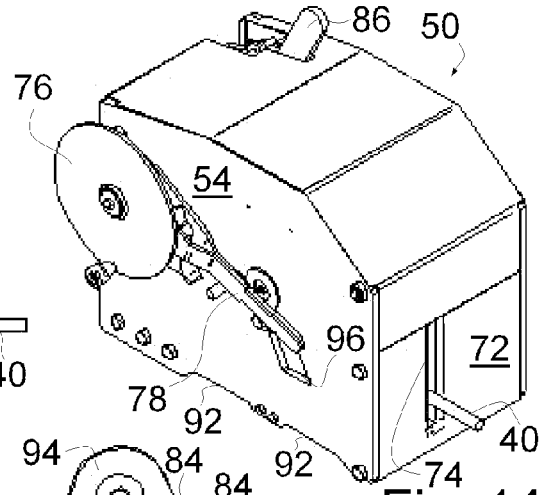
FIG. 14 is a right side perspective view of a single stack manual marine winch according to one aspect of the present invention with the wire rope winch line and the winch cover or housing added.
Figure 18:
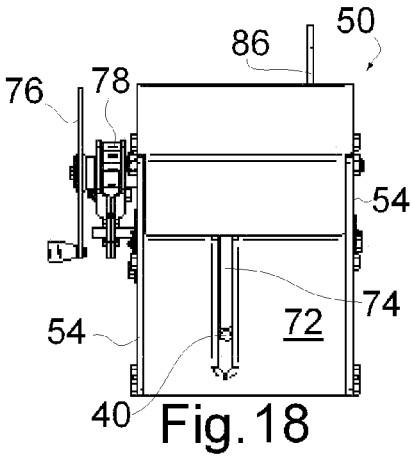
FIG. 18 is front elevation view of the marine winch of FIG. 14.
Figure 15:
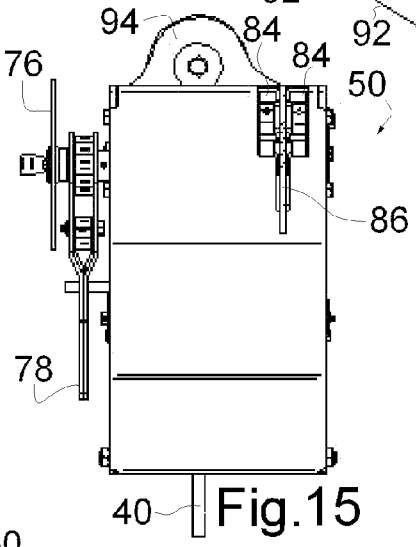
FIG. 15 is top plan view of the marine winch of FIG. 14.
Figure 19:
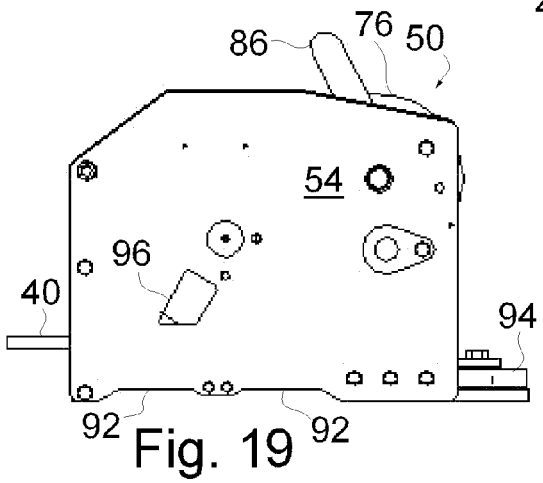
FIG. 19 is a left side elevation view of the marine winch of FIG. 14.
Figure 16:
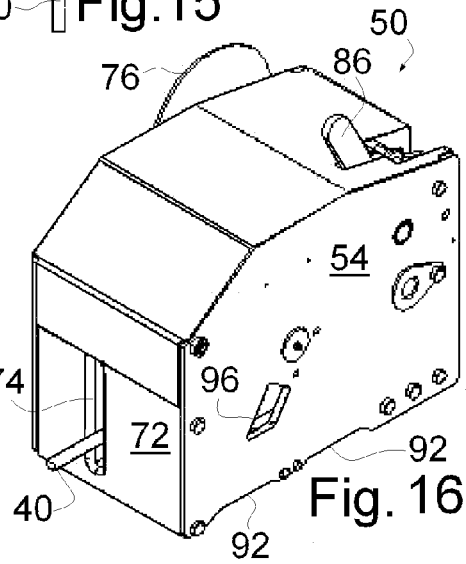
FIG. 16 is a left side perspective view of the marine winch of FIG. 14.
Figure 20:
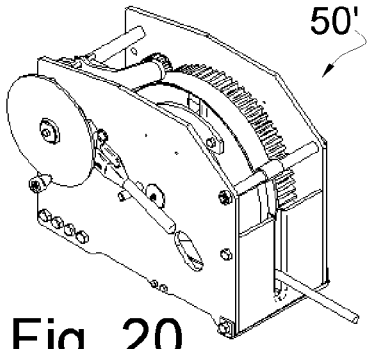
FIG. 20 is a right side perspective view of a single stack manual marine winch according to another aspect of the present invention with the wire rope winch line and winch cover or housing omitted for clarity similar to FIG. 1.
Figure 21:
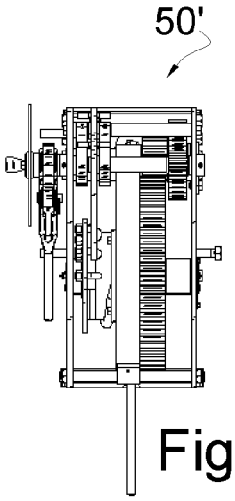
FIG. 21 is top plan view of the marine winch of FIG. 20.
Figure 22:
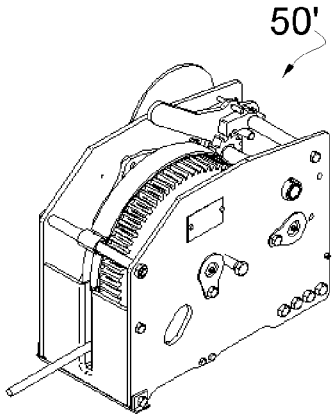
FIG. 22 is a left side perspective view of the marine winch of FIG. 20.
Figure 24:
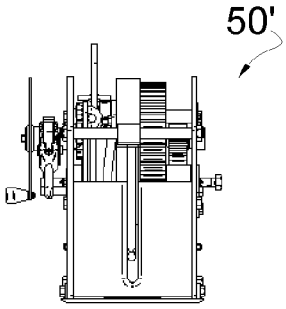
FIG. 24 is front elevation view of the marine winch of FIG. 20.
Figure 23:
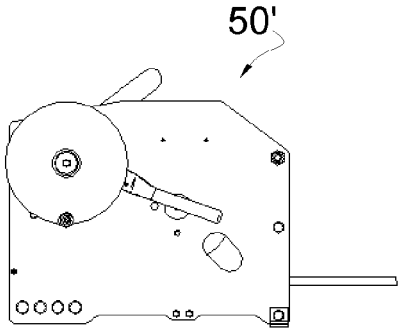
FIG. 23 is a right side elevation view of the marine winch of FIG. 20.
Figure 25:
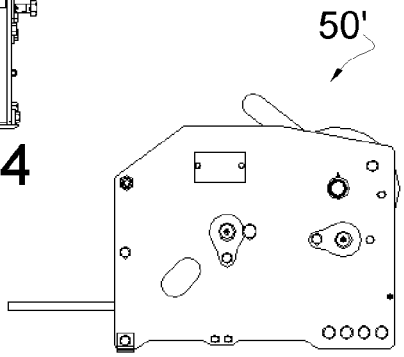
FIG. 25 is a left side elevation view of the marine winch of FIG. 20.
Figure 26:
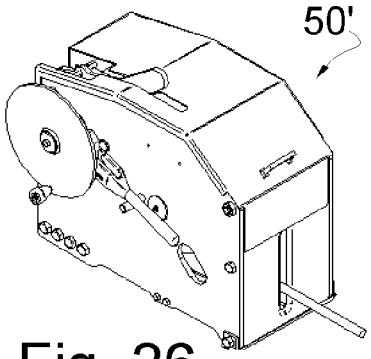
FIG. 26 is a right side perspective view of a single stack manual marine winch of FIG. 20 with the wire rope winch line and the winch cover or housing added.
Figure 27:
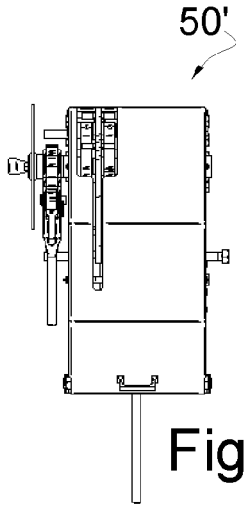
FIG. 27 is top plan view of the marine winch of FIG. 26.
Figure 28:
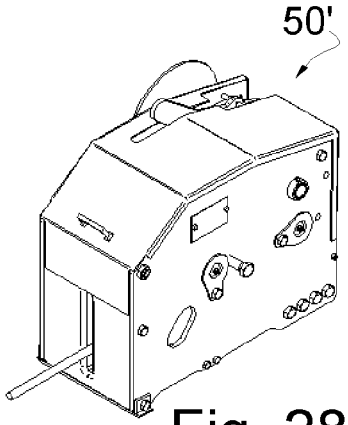
FIG. 28 is a left side perspective view of the marine winch of FIG. 26.
Figure 30:
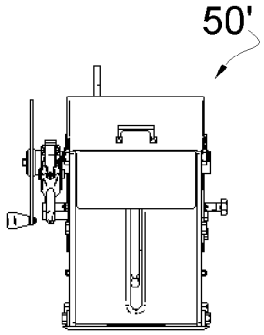
FIG. 30 is front elevation view of the marine winch of FIG. 26.
Figure 29:
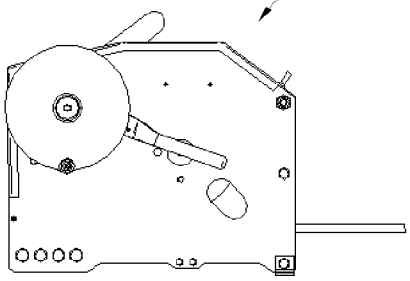
FIG. 29 is a right side elevation view of the marine winch of FIG. 26.
Figure 31:
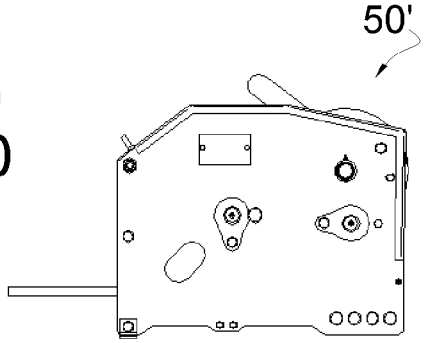
FIG. 31 is a left side elevation view of the marine winch of FIG. 26.

The front of the winch 50 includes protective plate 72 with rope access slot 74 further protecting the stacking space. As shown the winch 50 is preferably an under-winding winch meaning that the wire rope is spooled onto the underside of the drum 56. Adjacent the slot 74 is a guide channel 75 that essentially encompasses the wire rope 40 as it is directed to the single stacking space as best shown in FIG. 13. The guide channel 75 and slot 74 guide the wire rope 40 and serve to control the wire rope 40 and to properly stack the rope 40 and maintain the stack. In the construction as shown the channel is supported near the stacking space by a spacer or support 90. The channel 75, particularly with spacer 90 as shown, forms another over-winding limiting feature as the channel will not bias out of the way to allow more than a set maximum number of wraps on the stacking space.

The fender 70 and the controlled total adjustment of the winch 50 combine to minimize the need for an extra braking mechanism. The fender 70 will provide some retarding force for payout of the outermost wrap. However, a brake can be easily incorporated into the winch 50 if desired by the operator.

Other than the spool assembly disclosed above, the remaining elements of the winch 50 are conventional and known to those in the art. For example the winch includes a hand wheel 76 and lever tension mechanism, also known as a ratchet handle 78 is used to rotate the drum gear 60 through gearing 80 in a conventional fashion. The tension is held on ratchet gears 82 that are engages with pawls 84 with engagement and knockout lever 86, also known in the art.

Further conventional features of the winch 50 include a plurality of spacers 90 holding the side plates 54 apart, access opening 92 in the bottom of the side plates 54 to allow egress of debris, and pivot mounting 94 for pivot mounting of the winch 50. Further a winch cover as shown in figure(s) can be provided to provide a substantially closed operating surface for the winch 50 (note that the open bottom design can still be used to allow for easy egress of debris that does enter the winch 50).

The improvements in the winch 50 essentially relate to the spool assembly that includes a dead wrap area and a single stack area as described above. In operation, the user clamps the lead end of the winch line wire rope 40 onto the drum 56 at clamp 64. An opening 96 is in the side plates 54 to allow access to the clamp 64. As the wire rope 40 is wrapped around the drum 56 it will wind toward the flange 62 and then will pass through the slot 66 into the single stack area where the working wraps of the winch line 40 can be spooled in a single stack onto and off of the drum 56.

The single stack prevents the wire rope 40 from binding as noted above. These improvements provide a manual marine winch 50 that minimizes fouling, jamming, binding, bird-nesting or the like of the wire rope 40 and allows for single person operation throughout the winch use. The controlling of the total winch line adjustment in the present winch 50 will help assure that the deck hands are making the desired lashing arrangements in the same proper manner. The manual marine winch 50 when using a 1" wire rope, and 10" drum, provides for about 25 feet of rope adjustment in 6 wraps on the single stack resulting in a winch 50 height of about two feet. The amount of adjustment can be changed by the total number of wraps and changes in the drum diameter and wire gauge. Other sizes and adjustment lengths are possible and may be designed as desired and tailored to the users needs.

The concepts of the winch 50 can be included in non-swivel type winches as well. Further, the present invention also includes the modification of existing winches to accomplish some of the advantages of the winch 50 of the present invention. Specifically, the existing drums may be modified to include the dead wrap area and the single stack area of the present invention.

In a further modification of the present invention a visually indicating physical stop, such as a swaged fitting, also called a button, can be added to the wire rope 40 preventing excessive rope 40 from being wound onto the winch 50. The swaged fitting would be sized larger than the rope access slot 74 so it will abut against the plate 72 acting as a physical stop for the winch 50. The swaging of buttons onto wire ropes is known in the wire rope art as well as the mine roof bolt art (that utilizes wire rope segments).

Figure 32:
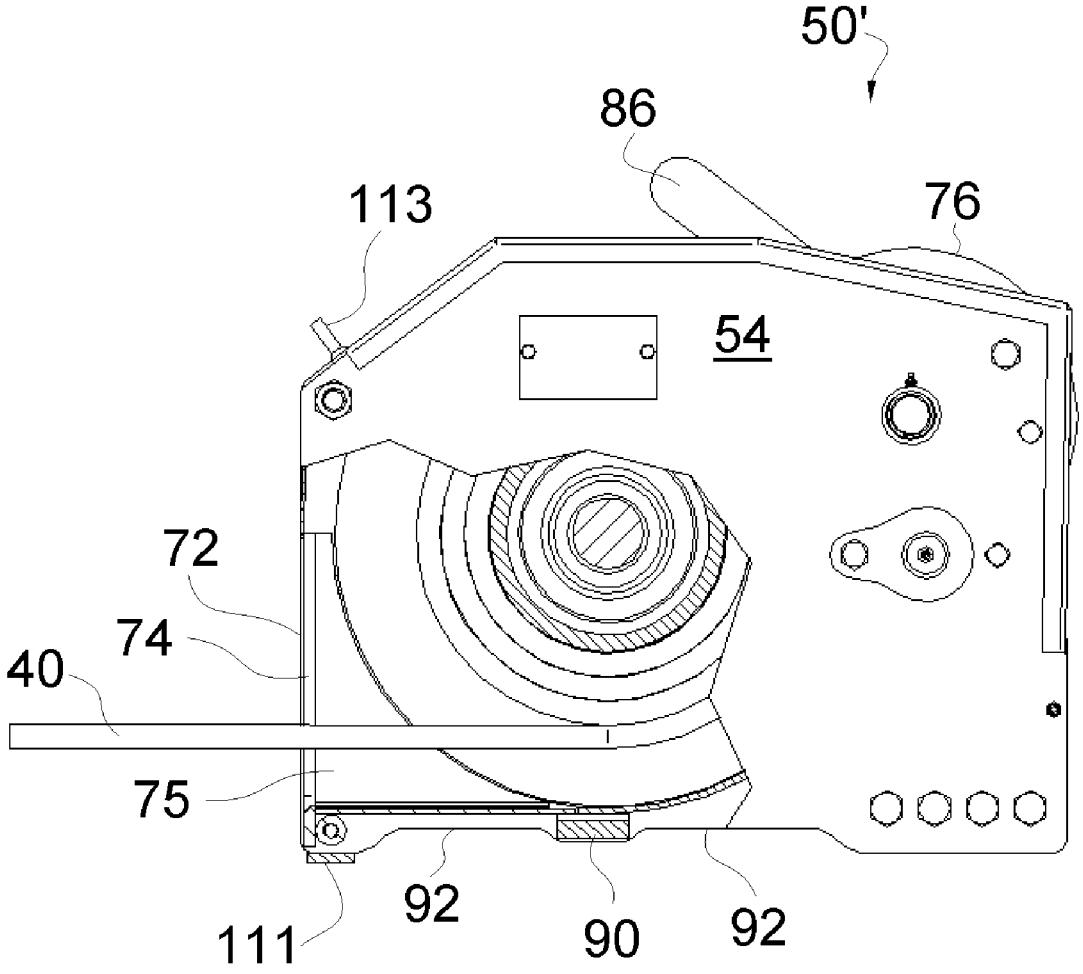
FIG. 32 is a left side elevation view partially in section of the marine winch of FIG. 26.
Figure 33:
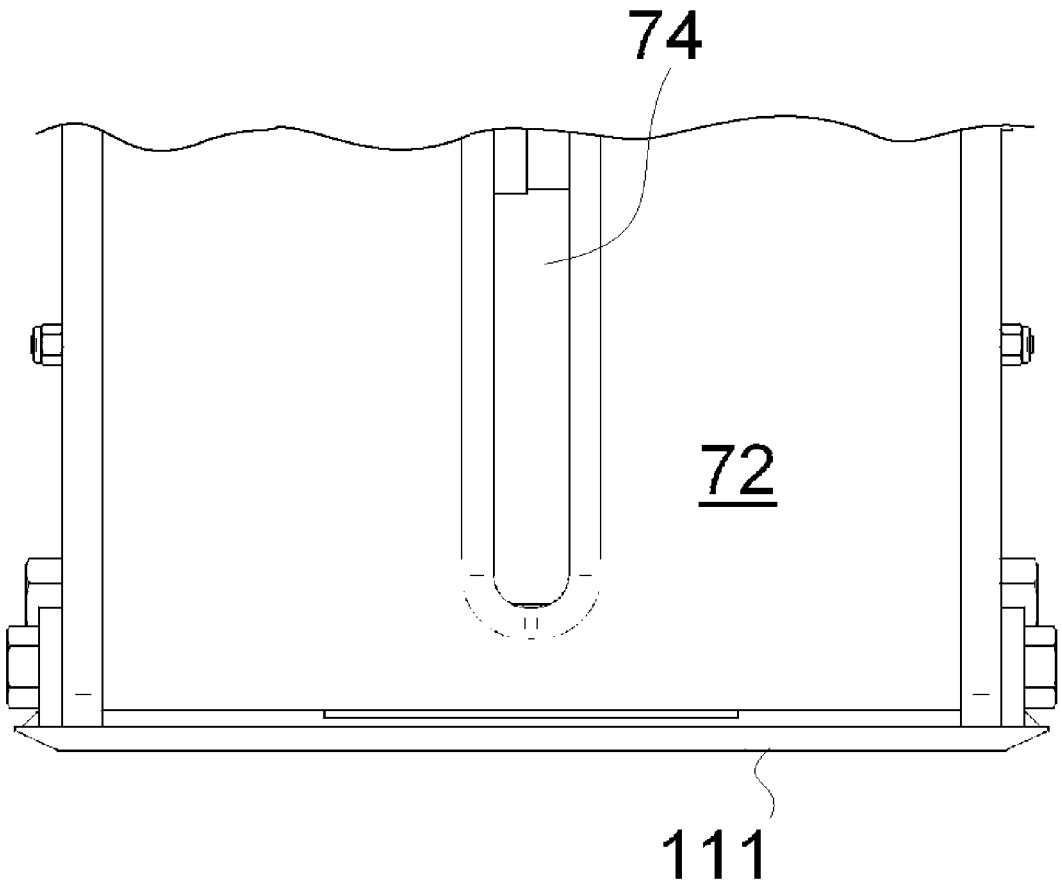
FIG. 33 is an enlarged front elevation view of the marine winch of FIG. 26.

FIGS. 20-33 illustrate a winch 50' substantially the same as described above in connection with winch 50. The winch 50' is intended to show some of the minor variations possible that do not depart from the operation of the winch of the present invention. The features and operation of winch 50' are substantially the same as with winch 50 described above and these common elements will not be described again. FIGS. 32 and 33 illustrate and label additional features of the winch 50' not described above. One feature includes a ramp 111 on the bottom of the winch 50' that allows the winch 50' to easily slide over welds and other barge deck irregularities. The ramped surfaces at the side edges are shown best in FIG. 33. The cover includes an access handle 113 to assist housing placement and removal.

Although the present invention has been described with particularity herein, the scope of the present invention is not limited to the specific embodiment disclosed. It will be apparent to those of ordinary skill in the art that various modifications may be made to the present invention without departing from the spirit and scope thereof. For example, a coupling could be added to the lead in end to the winch line 40 to have the lead in end constructed from chain, webbing or other desired line material. The location and design of the gearing can be changed for space considerations. The scope of the present invention is defined in the appended claims and equivalents thereto.

What is claimed is:

1. A manual marine winch comprising:

A winch line including a wire rope;

a pair of spaced side plates;

a rotating spool assembly supported between the side plates and including a drum, wherein the drum defines a wire rope stacking space on the drum for storing a single stack of wire rope, whereby the width of the wire rope stacking space is less than twice the diameter of the wire rope whereby the wire rope stacking space is configured to receive a only single stack of the wire rope in a spooled position; and a manually actuated control for spooling and un-spooling the wire rope into and out of the single stack of wire rope in the wire rope stacking space on the drum.

2. The marine winch of claim 1 wherein the drum includes a protecting flange on one side of the drum and a controlling drum gear on the other side of the drum.

3. The marine winch of claim 2 further including a stacking flange which is spaced from the drum gear a distance sufficient to receive only a single width of winch line, whereby the drum gear and the stacking flange define the wire rope stacking space.

4. The marine winch of claim 3 wherein the clearance between the wire rope on the drum centered between the drum gear and the stacking flange is 1-30% of the wire rope diameter on each side of the wire rope.

5. The marine winch of claim 3 wherein the drum further includes a dead wrap area between the stacking flange and the protecting flange.

6. The marine winch of claim 5 wherein the dead wrap area is designed to receive a single layer of wire rope with a plurality of wraps.

7. The marine winch of claim 5 further including a lead in clamp on the drum to receive the lead in end of the wire rope to begin the dead wraps.

8. The marine winch of claim 5 wherein the stacking flange includes a slot that permits the wire rope to pass from the dead wrap area to the stacking area.

9. The marine winch of claim 8 further including a removable hold down bar secured to the stacking flange extending across the slot which prevent the winch rope from pulling out of the winch.

10. The marine winch of claim 1 further including a stacking area cover forming a protective fender.

11. The marine winch of claim 10 further including a protective front plate with rope access slot extending between a front end of the side plates.

12. A pivoted manual marine winch for a barge deck, the winch comprising:

A winch line including a wire rope;

a pair of spaced side plates configured to be pivotably attached to a barge deck;

a rotating spool assembly supported between the side plates and including a drum, wherein the drum defines a wire rope stacking space on the drum for storing a single stack of wire rope, whereby the width of the wire rope stacking space is less than twice the diameter of the wire rope whereby the wire rope stacking space is configured to receive a only single stack of the wire rope in a spooled position; and a manually actuated control for spooling and un-spooling the wire rope into and out of the single stack of wire rope in the wire rope stacking space on the drum.

13. The marine winch of claim 12 wherein the drum includes a protecting flange on one side of the drum and a controlling drum gear on the other side of the drum.

14. The marine winch of claim 13 further including a stacking flange which is spaced from the drum gear a distance sufficient to receive only a single width of winch line, whereby the drum gear and the stacking flange define the wire rope stacking space.

15. The marine winch of claim 14 wherein the clearance between the wire rope on the drum centered between the drum gear and the stacking flange is 1-30% of the wire rope diameter on each side of the wire rope.

16. The marine winch of claim 14 wherein the drum further includes a dead wrap area between the stacking flange and the protecting flange.

17. The marine winch of claim 16 wherein the dead wrap area is designed to receive a single layer of wire rope with a plurality of wraps.

18. The marine winch of claim 16 further including a lead in clamp on the drum to receive the lead in end of the wire rope to begin the dead wraps, and wherein the stacking flange includes a slot that permits the wire rope to pass from the dead wrap area to the stacking area.

19. The marine winch of claim 12 further including a ramp coupled to the side plates of the winch configured to assist the winch to slide over barge deck irregularities.

20. The marine winch of claim 12 further including a physical stop on the winch line that prevents over wrapping of the winch line onto the winch.

* * * * *